US008192175B2

(12) United States Patent
Kuttler et al.

(10) Patent No.: US 8,192,175 B2
(45) Date of Patent: Jun. 5, 2012

(54) METHOD OF CONTROLLING A CYCLICALLY COMMUTATED HYDRAULIC PUMP

(75) Inventors: Onno Kuttler, Cousland/Dalkeith (GB); Ken Kin-ho Lai, Edinburgh (GB)

(73) Assignees: Sauer-Danfoss ApS, Nordborg (DK); Artemis Intelligent Power Ltd., Midlothian, Scotland (GB)

( * ) Notice: Subject to any disclaimer, the term of this patent is extended or adjusted under 35 U.S.C. 154(b) by 829 days.

(21) Appl. No.: 12/261,390

(22) Filed: Oct. 30, 2008

(65) Prior Publication Data

US 2009/0120086 A1 May 14, 2009

(30) Foreign Application Priority Data

Nov. 1, 2007 (EP) ..... 07254332

(51) Int. Cl.
*F16D 31/02* (2006.01)

(52) U.S. Cl. ..... 417/290

(58) Field of Classification Search ..... 417/53, 417/505, 290; 60/445; 251/149.9, 129.01, 251/129.16; 137/6, 88, 599.05
See application file for complete search history.

(56) References Cited

U.S. PATENT DOCUMENTS

| | | | |
|---|---|---|---|
| 4,321,014 | A | 3/1982 | Eburn, Jr. et al. |
| 4,815,946 | A | 3/1989 | Cusack |
| 5,046,926 | A | 9/1991 | Deininger et al. |
| 5,186,612 | A | 2/1993 | Budzich |
| 5,190,446 | A | 3/1993 | Salter et al. |
| 5,921,759 | A | 7/1999 | Khan |
| 6,055,851 | A | 5/2000 | Tanaka et al. |
| 6,126,418 | A | 10/2000 | Sinnl |
| 6,283,724 | B1 | 9/2001 | Alaze et al. |
| 6,681,571 | B2 | 1/2004 | Bailey et al. |
| 2004/0105763 | A1 | 6/2004 | Kondo |
| 2006/0039795 | A1 | 2/2006 | Stein et al. |
| 2009/0120086 | A1 | 5/2009 | Kuttler et al. |

FOREIGN PATENT DOCUMENTS

| | | | |
|---|---|---|---|
| DE | 4306377 | A1 | 9/1994 |
| EP | 0361927 | A1 | 4/1990 |
| EP | 0494236 | B1 | 7/1992 |
| EP | 0577783 | B1 | 12/1994 |
| EP | 1319836 | A2 | 6/2003 |
| EP | 1469237 | A1 | 10/2004 |
| EP | 1537333 | B1 | 6/2005 |
| EP | 2055943 | A1 | 5/2009 |
| EP | 2055944 | A1 | 5/2009 |
| EP | 2055945 | A1 | 5/2009 |
| EP | 2055946 | A1 | 5/2009 |
| GB | 968452 | | 9/1964 |
| GB | 1374752 | | 11/1974 |
| WO | 9105163 | A1 | 4/1991 |
| WO | 2004025122 | A1 | 3/2004 |

OTHER PUBLICATIONS

International Search Report dated Feb. 2, 2009 from Serial No. PCT/DK2008/000385. International Search Report dated Feb. 2, 2009 from Serial No. PCT/DK2008/000382.
International Search Report dated Feb. 2, 2009 from Serial No. PCT/DK2008/000381.
Jnternational Search Report dated Feb. 2, 2009 from Serial No. PCT/DK2008/000386.
International Search Report dated Feb. 2, 2009 from Serial No. PCT/DK2008/000384.

*Primary Examiner* — Karabi Guharay
*Assistant Examiner* — Elmito Breval
(74) *Attorney, Agent, or Firm* — McCormick, Paulding & Huber LLP

(57) ABSTRACT

When employing synthetically commutated hydraulic pumps (1), a time delay between a change in fluid flow demand (15) and the resulting fluid flow output (13) can be observed. It is suggested to use a time evolvement function, taking into account the time evolvement of the fluid flow demand and/or the time evolvement of the pumping strokes, to modify the actuation of the electrically commutated valves.

32 Claims, 7 Drawing Sheets

METHOD OF CONTROLLING A CYCLICALLY COMMUTATED HYDRAULIC PUMP

CROSS REFERENCE TO RELATED APPLICATION

Applicant hereby claims foreign priority benefits under U.S.C. §119 from European Patent Application No. 07254332.5 filed on Nov. 1, 2007, the contents of which are incorporated by reference herein.

FIELD OF THE INVENTION

The invention relates to a method of operating a fluid working machine, comprising at least one working chamber of cyclically changing volume, a high pressure fluid connection, a low pressure fluid connection and at least one electrically actuated valve connecting said working chamber to said high pressure fluid connection and/or said low pressure fluid connection, wherein the pumping and/or motoring strokes of said working chamber are controlled by an appropriate actuation of said electrically actuated valve. The invention further relates to a fluid working machine, comprising at least one working chamber of cyclically changing volume, a high pressure fluid connection, a low pressure fluid connection, at least one electrically actuated valve connecting said working chamber to a said high pressure fluid connection and/or said low pressure fluid connection and at least an electronic controller unit.

BACKGROUND OF THE INVENTION

Such fluid working machines are generally used, when fluids are to be pumped or fluids are used to drive the fluid working machine in a motoring mode. The word "fluid" can relate to both gases and liquids. Of course, fluid can even relate to a mixture of gas and liquid and furthermore to a supercritical fluid, where no distinction between gas and liquid can be made anymore.

Very often, such fluid working machines are used, if the pressure level of a fluid has to be increased. For example, such a fluid working machine could be an air compressor or a hydraulic pump.

Generally, fluid working machines comprise one or more working chambers of a cyclically changing volume. Usually for each cyclically changing volume, there is provided a fluid inlet valve and a fluid outlet valve.

Traditionally, the fluid inlet valves and the fluid outlet valves are passive valves. When the volume of a certain working chamber increases, its fluid inlet valve opens, while its fluid outlet valve closes, due to the pressure differences, caused by the volume increase of the working chamber. During the phase, in which the volume of the working chamber decreases again, the fluid inlet valve closes, while the fluid outlet valve opens due to the changed pressure differences.

A relatively new and promising approach for improving fluid working machines is the so-called "synthetically commutated hydraulic pumps", also known as "digital displacement pumps". These pumps are a subset of variable displacement pumps. Such synthetically commutated hydraulic pumps are known, for example, from EP 0 494 236 B1 or WO 91/05163 A1. In such pumps, the passive inlet valves are replaced by electrically actuated inlet valves. Optionally the passive fluid outlet valves are also replaced by electrically actuated outlet valves. By appropriately controlling the valves, a full-stroke pumping mode, an empty cycle mode (idle mode) and a part stroke pumping mode can be achieved.

Furthermore, if both inlet and outlet valves are electrically actuated, the pump can be used as a hydraulic motor as well. If the pump is run as a hydraulic motor, full stroke motoring and part-stroke motoring is possible, as well.

A major advantage of such synthetically commutated hydraulic pumps is their higher efficiency, as compared to traditional hydraulic pumps. Furthermore, because the valves are electrically actuated, the output characteristics of a synthetically commutated hydraulic pump can be changed very quickly.

For adapting the fluid flow output of a synthetically commutated hydraulic pump according to a given demand, several approaches are known in the state of the art.

It is possible to switch the synthetically commutated hydraulic pump to a full pumping mode for a certain time for example. When the synthetically commutated pump is operated in a pumping mode, a high pressure fluid reservoir is filled with fluid. Once a certain pressure level is reached, the synthetically commutated hydraulic pump is switched to an idle mode and the fluid flow demand is supplied by the high pressure fluid reservoir. As soon as the pressure of the high pressure fluid reservoir reaches a certain lower threshold level, the synthetically commutated hydraulic pump is switched on again.

This approach, however, necessitates a relatively large high pressure fluid reservoir. Such a high pressure fluid reservoir is expensive, occupies a large volume and is quite heavy. Furthermore, a certain variation in the output pressure will occur.

So far, the most advanced proposal for adapting the output fluid flow of a synthetically commutated hydraulic pump according to a given demand is described in EP 1 537 333 B1. Here, it is proposed to use a combination of an idle mode, a part-stroke pumping mode and a full-stroke pumping mode. In the idle mode, no fluid is pumped by the respective working chambers. In the full-stroke mode, all of the usable volume of the working chamber is used for pumping during the respective cycle. In the part stroke mode, only a part of the usable volume is used for pumping during the respective cycle. The different modes are distributed among several chambers and/or several successive cycles in a way, that the time averaged effective flow rate of fluid through the machine satisfies a given demand.

In controlling methods, which have been employed so far, a fluid flow demand, usually expressed as the displacement demand, is used as the (main) input parameter. The displacement demand is expressed as a certain percentage of the maximum displacement of the fluid working machine. The displacement demand is given by e.g. the position of a command (e.g. joy stick, pedal, throttle or the like), operated by an operator. In the controller, the displacement demand, which is expressed as a certain percentage of the maximum displacement of the fluid working machine is considered by using the so-called "accumulator" variable. The accumulator sums up the demand in a variable, used in an electronic controller unit, controlling the operation of the fluid working machine. As soon as a certain threshold level of the accumulator has been reached, a pumping cycle of the next following working chamber is initiated and the accumulator is decreased by an amount, corresponding to the volume to be pumped.

In the very first synthetically commutated hydraulic pumps, only idle strokes and full-stroke pumping cycles were used. Here, the accumulator integrated the fractional demand. As soon as the accumulator exceeded 100%, a full stroke pumping cycle was initiated and the accumulator would be decreased by 100%, accordingly.

In EP 1 537 333 B1 an additional part stroke mode of a certain, previously defined displacement fraction was suggested. Here, depending on the demand and the value of the accumulator, a part stroke or a full stroke pumping cycle would be initiated and the accumulator would be decreased by an appropriate value.

However, in practical applications, the control algorithms known in the state of the art have severe drawbacks, especially under certain working conditions.

One major drawback is pulsations, positive and negative pressure spikes occurring under certain working conditions. If, for example, the demand is very low, it takes a very long time for the accumulator to rise to a value beyond the threshold, before a stroke is finally initiated. The resulting pressure variations can be noticed during the movement of a hydraulic consumer (e.g. a hydraulic piston or a hydraulic motor). Also, a start-stop movement (a "sticking" behaviour) can be noticed. The pressure pulsations can even lead to the destruction of certain parts of the hydraulic system.

SUMMARY OF THE INVENTION

It is therefore the object of the invention to provide a method for controlling a synthetically commutated hydraulic pump in a way that pressure pulsations can be decreased.

For solving this object, it is proposed, to modify the method according to the preamble of claim 1 in a way, that the actuation of said electrically actuated valve is modified by a time evolvement function, taking into account the time evolvement of the fluid flow demand on the high pressure side and/or the time evolvement of said working chambers' pumping/motoring strokes. Generally speaking, this can be done in a way, such that a given demand is satisfied at an earlier time than usual, preferably at the earliest sensible moment. Satisfying the demand at an earlier time will allow more flexibility for future decisions. If a certain demand is already satisfied at time $t-\Delta t$, as compared to time t in conventional systems, an increased demand can already be satisfied at time t. In conventional systems, one had to wait until time $t+\Delta t$. For example, the inventor has surprisingly realised, that a pumping cycle needs some time to be completed, once it is initiated. This means, as a consequence, that a working chamber, being involved with a pumping cycle, is no longer available for additional pumping until the respective working cycle is completed. Therefore, it may actually be problematic, to start a full stroke pumping cycle, because the respective cylinder will be blocked for a full revolution of the fluid working machine. Surprisingly, no one has realised so far, that a given demand can very often be satisfied in another way as well. For example, if a six cylinder pump with equally spaced cylinders is used as a fluid working machine, a 100% demand can be satisfied by initiating a full-stroke pumping cycle. However, it is preferred to use the two or three previous cylinders, which already started their contraction cycle, to satisfy the 100% demand. This can be done by using the first cylinder with its remaining contractable volume of 25% and the second cylinder with its 75% remaining contractable volume for part stroke pumping. Both remaining contractable volumes add up to 100%. This will leave the actual cylinder for a possible future increase in fluid flow demand. In addition to this, knowledge about the time evolvement of the cylinder's pumping ability can be used as well to avoid pressure peaks, by excluding certain stroke patterns of the cylinders.

The fluid flow demand normally comes as an input from an operator, operating the machinery, in which the fluid working machine is installed. The fluid flow demand can be derived from the position of a command (e.g. a command lever, a paddle, a throttle, a joystick, the engine speed or the like). Of course it is also possible, that the fluid flow demand is determined by an electronic controller, for example. It is also possible, that the electronic controller determines (or influences) the fluid flow demand only under certain working conditions. This could be, for example, a shutdown under critical working conditions, or a reduction in power, because there is a risk of engine overheating.

A preferred embodiment can be realised if the time evolvement function is able to trigger a pumping/motoring stroke for a plurality of working chambers and/or at a plurality of phases of each working chamber's working cycle. The pumping/motoring stroke is of course an active one. Previously, the decision of whether to initiate a pumping stroke or not, and about the displacement fraction to be chosen, was done slightly before the bottom dead centre of the respective cylinder and only for this single cylinder. According to this embodiment, it is not only suggested to trigger a pumping stroke (i.e. to make a decision about a pumping stroke) for more than one working chamber at a time, but also at several points during the working cycle of the respective working chamber(s). The decision can also be done during a continues time interval. This can increase the responsiveness of the pump and can decrease pressure pulses.

It can be advantageous, if the time evolvement function comprises a spacing function, so that successive pumping/motoring strokes are spaced in time in a way to smooth the fluid output flow to said high pressure fluid connection. In particular, this should be done for the peak output phases of successive pumping/motoring strokes. A very simple implementation could be, for example, that the initiation of a part stroke pumping cycle is prohibited, during the high peak fluid output phase of a certain working chamber. In particular this exclusion can be done, if the part stroke would be around a 50% fractional value, because it would start during a phase of very high fluid flow output of the previous working chamber. It is noted, that using this embodiment pumping work, that could in principle be performed at an earlier time, is moved slightly backwards in time. However, the avoidance of pressure pulsations can overweight this slight disadvantage.

According to another embodiment of the invention, the time evolvement function comprises a vectorised variable, being indicative of the time dependency of the fluid output flow during a pumping stroke. In other words, for implementing the time evolvement function numerically, it is suggested to use a vectorial accumulator instead of a scalar accumulator. The decision of whether to initiate a pumping stroke or not can depend on one or on several fields of the vector. The update of the vectorised variable can comprise adding or subtracting a value to/from one or several fields. Furthermore, it can comprise a shifting of one or several fields of the vectorised variable. If more fields ("dimensions" or phases) are used for the vectorised variable, the accuracy and the time responsiveness of the pump can be enhanced. However, the enhancement can become negligible at some point. This point normally depends on the actual application. Furthermore, the workload of updating the vectorised variable can increase to an undesirable level. Therefore, a good compromise should be chosen for each individual application.

Another possible embodiment is achieved, if the time evolvement function comprises a variable being indicative of a fluid flow demand, wherein a threshold level of said variable is chosen in a way that a pumping/motoring stroke is initiated in advance of the actual demand. When using an accumulator, this could be realised by setting the threshold level to a level lower than the percentage of the pumping cycle that will be initiated. For example, an accumulator value of 50% could initiate a full stroke pumping cycle (100% stroke). This, of course, can imply, that the accumulator can have negative values. The threshold level can be chosen, depending on the demand, i.e. the slope of the accumulator. Using this embodiment, one might still suffer from certain imperfections. But it has the advantage, that it can be easily implemented with existing synthetically commutated hydraulic pumps.

It is preferred, if a plurality of electrically actuated valves are controlled using the suggested method. Particularly, the respective electrically actuated valves are connected to different working chambers of the fluid working machine. In this way, the advantages of the present invention will be even more predominant. In particular, the responsiveness of the pump can be increased, while the pressure pulses can be further decreased.

It is further suggested, that the pumping/motoring strokes, in particular the initiation of the pumping/motoring strokes of the working chambers are out of phase to each other. In other words, the respective bottom dead centre of each working chamber is reached at a different point in time, when the fluid working machine is revolving or moving. However, this does not exclude that in a hydraulic pump/motor, comprising several banks of cylinders, the pumping/motoring strokes of corresponding working chambers are initiated at the same time, respectively. However, it is also possible to provide several banks, which are offset from each other, so that the initiation of the pumping/motoring strokes of the working chambers of two adjacent banks are out of phase to each other.

The object of the invention is also solved, if a fluid working machine, comprising at least one working chamber of cyclically changing volume, a high pressure fluid connection, a low pressure fluid connection, at least one electrically actuated valve connecting said working chamber to said high pressure fluid connection and/or said low pressure fluid connection and at least an electronic controller unit is built in a way, that the electronic controller unit comprises a time evolvement consideration means that is designed and arranged in a way, that the electronic controller unit performs a method according to at least one of the previously described embodiments of the invention. If a plurality of working chambers is present, a high-pressure fluid manifold and/or a low pressure fluid manifold can be used.

BRIEF DESCRIPTION OF THE DRAWINGS

Further objects and advantages of the inventions will be apparent from the following description of embodiments, which is given with reference to the enclosed figures. The figures show.

DETAILED DESCRIPTION

Figure 1:
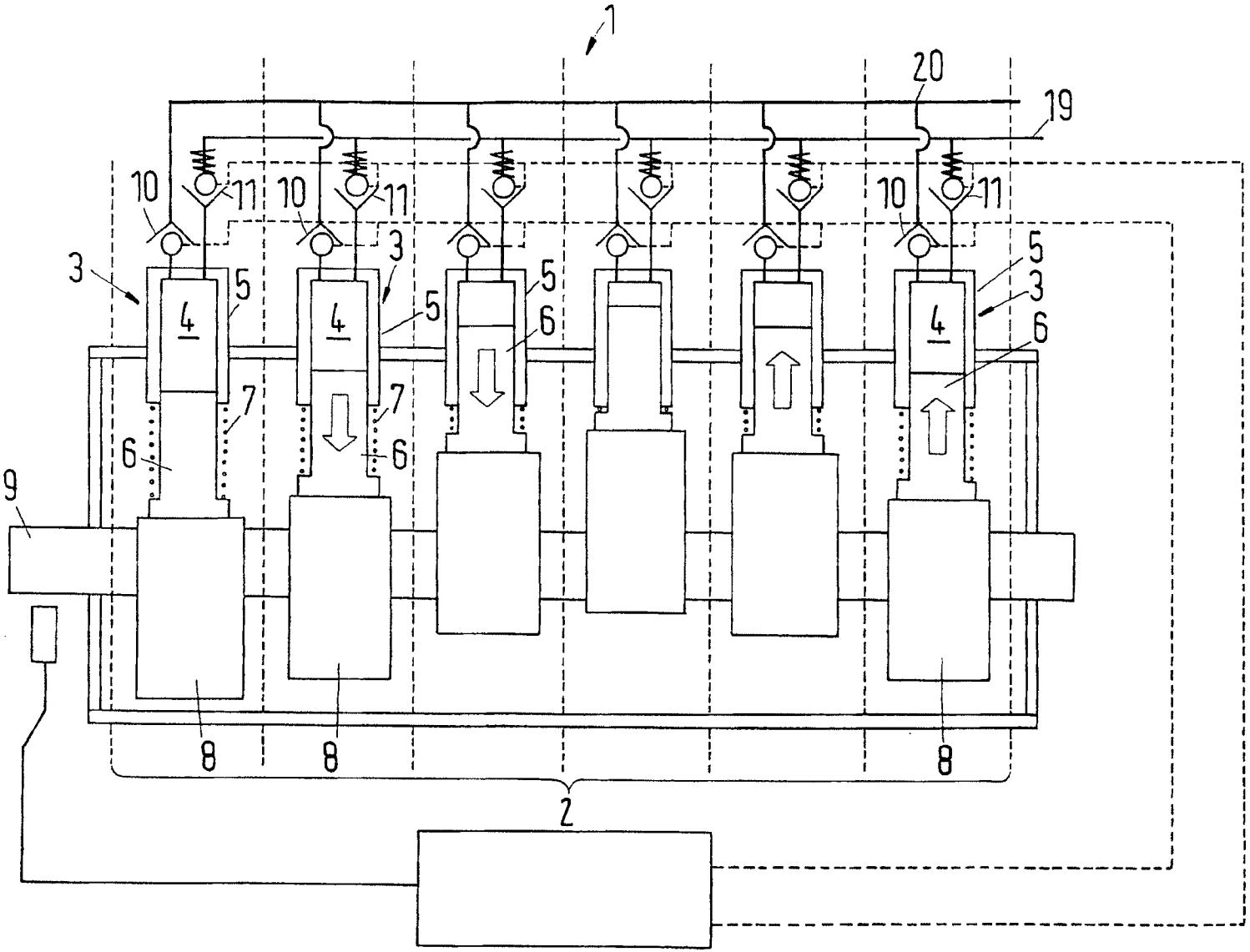
FIG. 1: is a schematic overview of a synthetically commutated hydraulic pump, comprising one bank with six cylinders.

In FIG. 1, an example of a synthetically commutated hydraulic pump 1, with one bank 2, having six cylinders 3 is shown. Each cylinder has a working space 4 of a cyclically changing volume. The working spaces 4 are essentially defined by a cylinder part 5 and a piston 6. A spring 7 pushes the cylinder part 5 and the piston 6 apart from each other. The pistons 6 are supported by the eccentrics 8, which are attached off-centre of the rotating axis of the same rotatable shaft 9. In the case of a conventional radial piston pump ("wedding-cake"-pump), multiple pistons can also share the same eccentric 8. The orbiting movement of the eccentric 8 causes the pistons 6 to reciprocally move in and out of the respective cylinder parts 5. By this movement of the pistons 6 within the cylinder parts 5, the volume of the working spaces 4 is cyclically changing.

In the example shown in FIG. 1, the synthetically commutated hydraulic pump 1 is of a type with electrically actuated inlet valves 10 and electrically actuated outlet valves 11. Both inlet valves 10 and outlet valves 11 are fluidly connected to the working chambers 4 of the cylinders 3 on one side. On the other side, the valves are fluidly connected to a low pressure fluid manifold 20 and a high pressure fluid manifold 19, respectively.

Because the synthetically commutated hydraulic pump 1 has electrically actuated outlet valves 11, the synthetically commutated hydraulic pump 1 can be used as a hydraulic motor as well.

Of course, the design could be different from the example shown in FIG. 1. For example, several banks 2 of cylinders 3 could be provided for. It's also possible that one or several banks 2 show a different number of cylinders 3, for example four, five, seven and eight cylinders. Although in the example shown in FIG. 1, the cylinders 3 are equally spaced within a full revolution of the shaft 9 (i.e. 60° out of phase to each other), the cylinders 3 could be spaced unevenly, as well. Another possible modification is achieved, if the number of cylinders in different banks 2 of the synthetically commutated hydraulic pump 1 differ from each other. For example, one bank 2 might comprise six cylinders 3, while a second bank 2 of the synthetically commutated hydraulic pump 1 comprises just three cylinders 3. Furthermore, different cylinders can show different displacements. For example, the cylinders of one bank 2 could show a higher displacement, as compared to the displacement of the cylinders of another bank.

Of course, if the hydraulic working machine 1 is used as a hydraulic motor, a valve, which is used as a fluid inlet valve 10 in the pumping mode will become a fluid outlet valve in the motoring mode and vice versa.

Of course, not only piston and cylinder pumps are possible. Instead, other types of pumps can take advantage of the invention as well.

Figure 2:
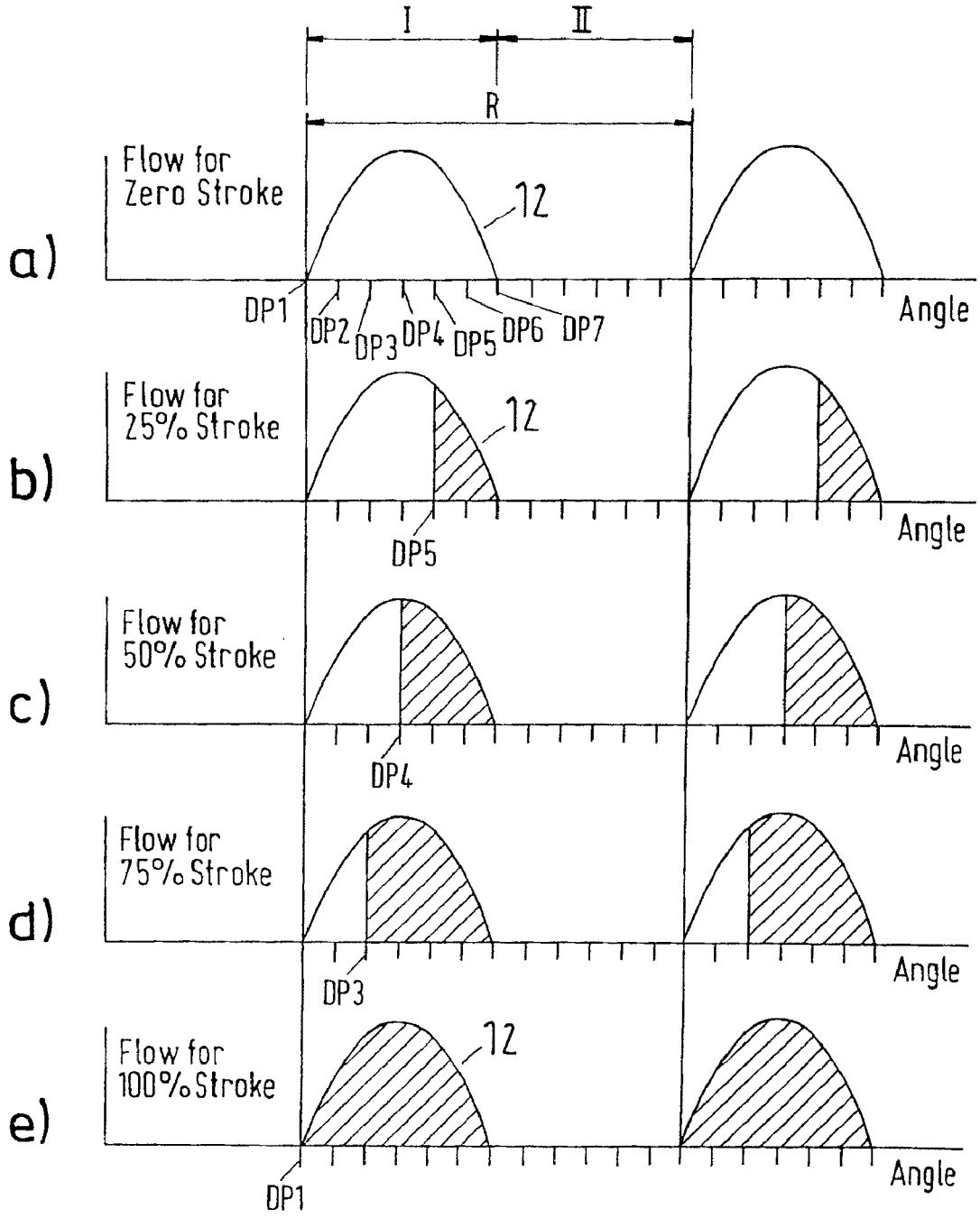
FIG. 2: illustrates the fluid output of a single, synthetically commutated cylinder in different modes.

FIG. 2 gives an overview of the fluid flow output of a single cylinder 3 towards the high pressure side. The fluid flow output 12 is depicted for several modes a-e. In each diagram the ordinate shows the fluid flow output, while the abscissa shows the time. In FIG. 2, the time is expressed as the rotating angle of the rotable shaft 9. Assuming a constant speed, angle and time are proportional to each other. Each tick on the abscissa represents an angle of 30°. A full revolution of the rotable shaft 9 is indicated by R. As can be seen in FIG. 2, a full revolution R comprises two phases, namely a volume contraction phase I and a volume expansion phase II. During the volume contraction phase I, the piston 6 is pushed into the cylinder part 5 by the eccentric 8, and therefore the volume of the working chamber 4 decreases. During volume expansion phase II, the outer surface of the eccentric 8 moves away from the cylinder 3. The piston 6 is therefore pushed away from the cylinder part 5 due to the force, exerted by the spring 7. Hence, the volume of the working chamber 4 increases. DP 1 indicates the so-called bottom dead centre of the cylinder 3, while DP 7 indicates the top dead centre of the cylinder 3.

In FIG. 2 *a*), a zero stroke pumping mode (idle mode) is shown. In other words, the synthetically commutated hydraulic pump 1 is in an idle mode. In this mode, the inlet valve 10 then remains open all the time. Hydraulic fluid is therefore sucked into the working chamber 4 via the inlet valve 10 during the volume expansion phase II. However, because the inlet valve 10 remains open during the volume contraction phase I, hydraulic fluid is pushed out of the working chamber 4 back into the fluid inlet manifold 20 via the same path, i.e. through inlet valve 10. Therefore, no effective pumping (i.e. no pumping towards the high pressure fluid manifold 19) is performed in zero stroke mode (idle mode).

On the contrary, in FIG. 2 *e*), the 100% stroke (full stroke) pumping mode is shown. Here, the inlet valve 10 is moved to its closed position right at DP 1, i.e. the bottom dead centre of the cylinder 3. Therefore, during volume contraction phase I, pressure builds up within the working chamber 4 and eventually fluid outlet valve 11 will open under the resulting pressure difference, so that the fluid flow output will be expelled towards the high pressure fluid manifold 19. This is indicated by the hatched area under curve 12. Of course, at DP 7 (top dead center), the fluid inlet valve 10 will be opened again. This pumping behaviour is equivalent to traditional hydraulic pumps with two passive valves.

However, synthetically commutated hydraulic pumps offer more possibilities:

Looking at FIG. 2 *b*), a 25% stroke mode is shown. Initially, the fluid inlet valve 10 remains open during the volume contraction phase I. Therefore, the fluid flow output 12 is first expelled towards the low pressure manifold 20. This is indicated by the white area under curve 12. However, at an angle of 120° (DP 5), the fluid inlet valve 10 is closed. Now, pressure builds up in the contracting volume chamber 4, fluid outlet valve 11 will open under the resulting pressure difference and the fluid flow output 12 is expelled towards the high pressure fluid manifold 19. This is indicated by the hatched area under curve 12. The effective fluid flow output towards the high pressure fluid manifold 19 is about 25% of the total volume contraction of the working chamber 4. At DP7, the fluid inlet valve 10 is opened again.

In an analogous way, a 50% stroke mode (FIG. 2 *c*) and a 75% stroke mode (FIG. 2 *d*) can be realised. It should be noted, that it is also possible, to realise any displacement fraction in-between, by appropriately selecting the closing time of the inlet valve 10 (also known as firing angle, firing time, closing angle) of the respective cylinder 3.

Figure 3A:
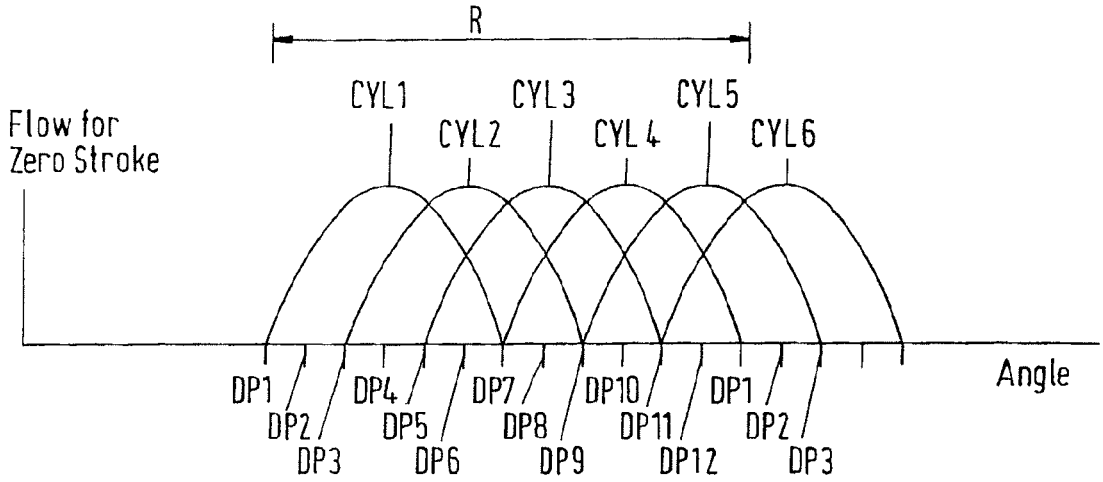
FIG. 3*a, b*: illustrate the overlapping fluid output of a six cylinder synthetically commutated hydraulic pump in different working modes.
Figure 3B:
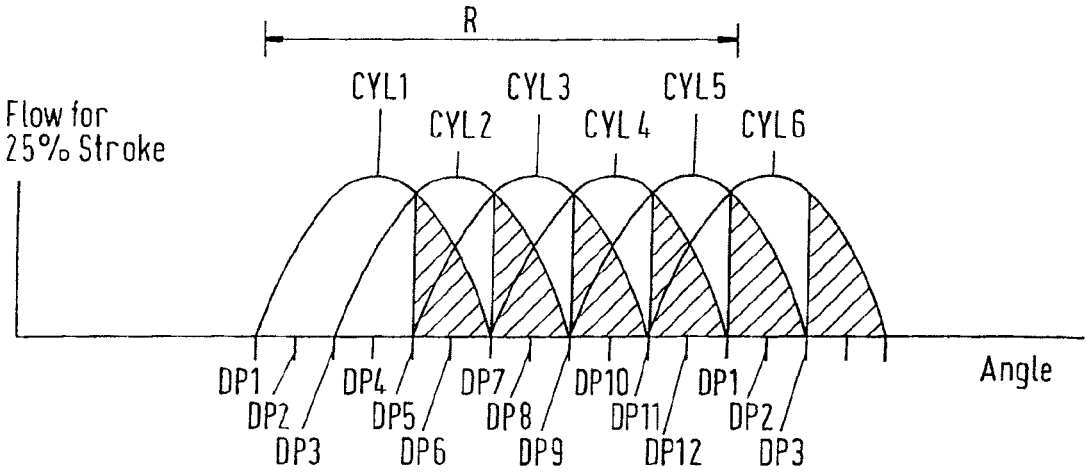

FIG. 3 illustrates, how the different cylinders 3 of the synthetically commutated hydraulic pump 1 work together. For brevity, only two modes are shown. In FIG. 3 *a*), a zero stroke mode is shown (see FIG. 2 *a*), while in FIG. 3 *b*) a 25% stroke mode is shown (see FIG. 2 *b*).

As can be seen from FIG. 3, the working cycles of the six cylinders 3 are out-of-phase to each other, with a spacing of 60° in-between (one tick on the abscissa equals to a 30° rotation angle of rotatable shaft 9). After a full revolution R, a working cycle of the synthetically commutated hydraulic pump 1 is started once again.

In algorithms, known in the state of the art (i.e. as described in EP 1 537 333 B1) and employed in practical applications, the controller decided only at one single point in time for only one cylinder about the opening and closing of the inlet valve 3: The decision was made at the bottom dead centre of the respective cylinder 3 (in reality slightly before that time, to take into account the closing time of inlet valve 10). Therefore, the decision on whether to close inlet valve 10 of cylinder No. 1 at all, and at what time the closing has to be done (determining the volume fraction to be pumped to the high pressure side) is made at DP 1, the bottom dead centre of cylinder No. 1. Likewise, the decision for cylinder No. 2 was made at the bottom dead centre of cylinder No. 2, i.e. at DP 3; the decision about cylinder No. 3 at the bottom dead centre of cylinder No. 3, i.e. at DP 5, and so on.

As can be seen from FIG. 3 *b*), this gives rise to an unnecessary delay in reaction time. Let's assume that the fluid flow demand will rise from 0 to 25% at DP 4. With previously known algorithms, a decision would be made at DP 5 for cylinder No. 3. Therefore, the actuation of inlet valve 10 of cylinder 3 will be performed at DP 9 and beginning at DP 9, a fluid flow output will be performed. Therefore, a time delay of five ticks, i.e. of five times 30° equals 150° between the demand and the actual fluid flow output occurs.

On the contrary, according to an embodiment of the invention, a decision will be made at the time, when the demand changes, i.e. at DP 4 in this example. At DP 4, it is realised, that cylinder No. 1 has not yet reached the point, that is not able anymore to provide a displacement fraction of 25%. The respective borderline is DP 5. Of course, the same is true for cylinder No. 2 and No. 3. However, the proposed algorithm will use the earliest (sensible) point in time, that is possible, and will therefore decide to use cylinder No. 1 for pumping. Therefore, at DP 5 the inlet valve 10 of cylinder No. 1 is closed and the pumping will be performed. As it is easily understandable, the time delay between fluid flow demand change and the delivery of a high pressure fluid flow amounts only to an angle of 30° in the given example.

It should be noted that another advantage of the selection of cylinder 1 is, that neither cylinder No. 2 nor cylinder No. 3 are "blocked" for future use. If, for example, the fluid flow demand should rise to 50% at DP 5, cylinder No. 2 is still available for pumping. Therefore, the inlet valve 10 of cylinder No. 2 will be closed at DP 6 and a 50% stroke pumping cycle will be performed.

As another example, if the fluid flow demand would rise to 75% at DP 6, cylinder No. 3 is still available for pumping a fraction of 75%. Therefore, the control unit could actuate the inlet valve 10 of cylinder No. 3 at DP 7. Of course, it would be also possible to actuate inlet valve 10 of cylinder No. 2 right at DP 6 for performing a 50% part-stroke cycle and, additionally to actuate inlet valve 10 of cylinder No. 3 at DP 9 for performing a 25% stroke. In total, this would amount to 75% as well.

In particular according to the invention, it is possible to decide at one moment in time about the actuation of more than one cylinder 3. It is even possible to actuate more than one cylinder 3 at one time.

Figure 4:
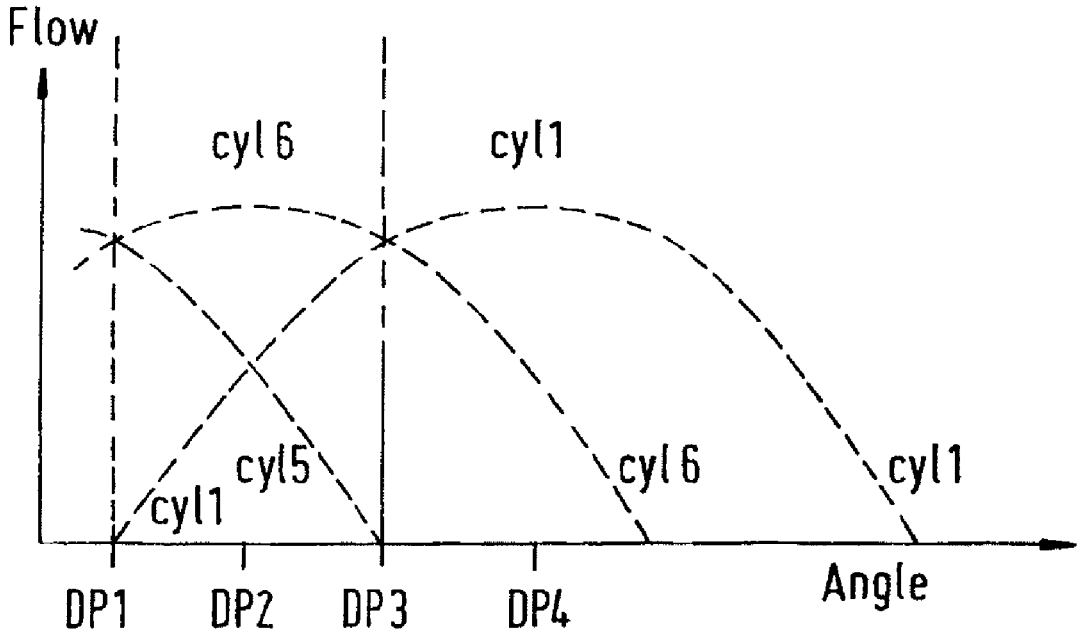
FIG. 4: illustrates the multiple decision principle.

If, for example, at point DP 1 of FIG. 4 the fluid flow demand is 100%, current algorithms would decide to satisfy this demand by performing a full pumping cycle stroke of cylinder No. 1. However, it is also possible to actuate at DP 1 both cylinders No. 5 and No. 6. Cylinder No. 5 is already in a progressed part of its volume contraction cycle I, so that it can only provide a 25% volume fraction. However, inlet valve 10 of cylinder No. 6 is actuated at the same time. Cylinder No. 6 has started its volume contraction cycle I as well, and can still provide a 75% volume fraction. The sum of the fluid flow output of cylinder No. 5 and cylinder No. 6 adds up to a 100% fraction, which is equal to the demand. As an advantage, cylinder No. 1 is not (yet) actuated, and can still be used for performing additional pumping work.

Another advantage of the multiple decision performed at DP 1 is, that the output fluid flow reaction is faster as compared to an actuation of the inlet valve 10 of cylinder No. 1. Although in the example of FIG. 4, cylinder No. 1 will output some fluid starting with DP 1, its fluid flow output is still quite low in the time interval between DP 1 and DP 3 (indicated by the shaded area), and amounts to only 25% of the requested flow demand.

However, by actuating cylinder No. 5 and cylinder No. 6 at DP 1 within the same time interval from DP 1 to DP 3 75% (25%+50%) of the fluid flow demand can be satisfied. Therefore, the reaction is much faster. It is to be noted, that during the remaining interval of cylinder 6 between DP 3 and DP 6, another 25% is pumped. Therefore, the total fluid output flow is 100%.

It is noted, that another possibility to satisfy the 100% request at DP 1 would be to actuate cylinder No. 6 at DP 2 and cylinder No. 1 at DP 4. This would yield a 50% plus 50%=100% fluid flow output. The advantage would be, that the fluid flow output will show a less distinct fluid flow output peak. This can result in lower pressure pulsations, which might be problematic in certain applications.

Of course, another possibility would be to use cylinders 5, 6 and 1. A possible way to satisfy the 100% request would then be to actuate cylinder 5 at DP 1 (yielding a 25% fraction), to actuate cylinder 6 at DP 2 (yielding a 50% volume fraction) and to actuate cylinder 1 at DP 5 (yielding a 25% volume fraction). This sums up to a total of 100%.

Yet another possibility to satisfy a 100% request would be to actuate cylinders 5, 6 and 1 all at DP1. Between DP1 and DP3 cylinder 5 will provide a 25% volume, cylinder 6 will provide 50% out of the total of 75% and cylinder 1 will provide the first 25% of the 100% volume. This will result in the quickest way to satisfy the 100% request. However, in such a case, trailing volume will follow at the expense of the quick response. In the example cited, cylinder 6 will provide another 25% after DP3 while cylinder 1 will provide another 75%. This can be handled with the concept of phased (vectorial) accumulator.

Figure 5:
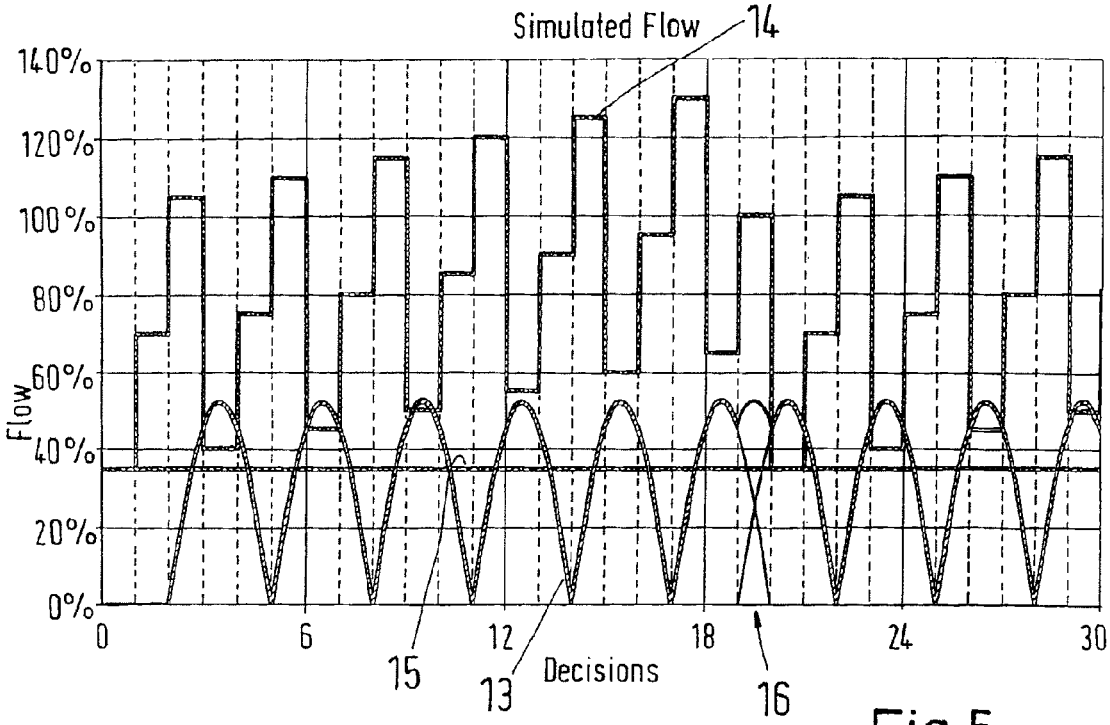
FIG. 5: illustrates the fluid output of a synthetically commutated hydraulic pump, using a standard accumulator.
Figure 6:
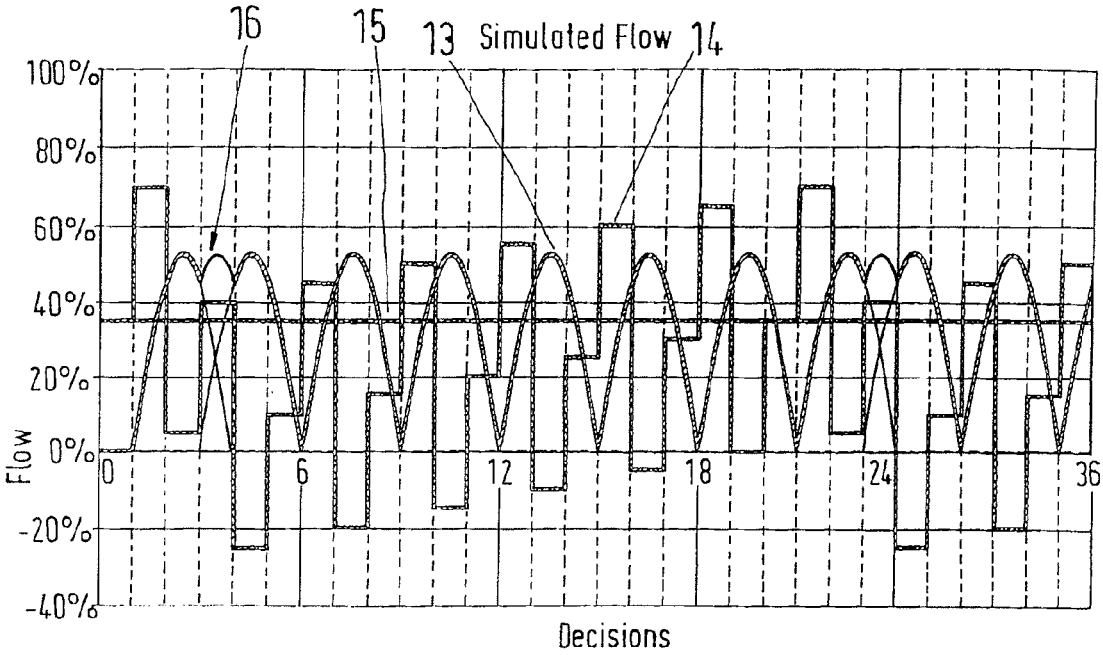
FIG. 6: illustrates the fluid output of a synthetically commutated hydraulic pump, using an accumulator with an offset.
Figure 7:
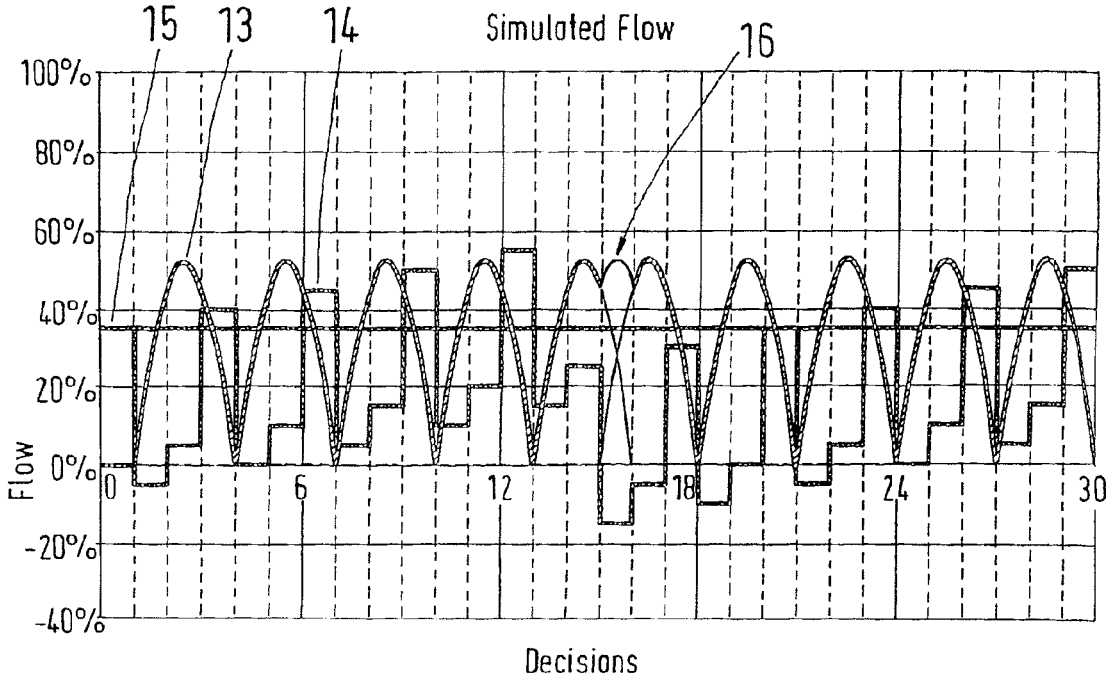
FIG. 7: illustrates the fluid output of a synthetically commutated hydraulic pump, using a phased accumulator variable.

Referring to FIG. 5 to 7, a different aspect of the invention will be explained. In all three diagrams the fluid flow demand 15 is set to 35%. The development of the value of the accumulator 14 as well as the fluid flow output 13 is shown. In FIG. 7, the graph for the accumulator 14 shows the first dimension for the three dimensional accumulator vector. Furthermore, it is noticed, that only full-stroke pumping cycles are performed to satisfy the demand. The suggested algorithms can, however, be equally employed using part-stroke cycles as well.

In FIG. 5, the conventional algorithm is depicted. The accumulator variable 14 builds up and as soon as 100% is reached, a pumping pulse is initiated and the accumulator 14 is decreased by 100%. Because the demand 15 is 35%, it is slightly higher than the time average of 33%, which is an output of a series of two idle strokes and a full stroke, following repeatedly after each other. Therefore, at some point a series of two pulses with only one idle stroke in-between is performed once in a while, yielding the overall fluid output 13 of a three-tip spike 16. It has to be noted, that the three-tip spike 16 takes quite some time to develop. This is equivalent to a time delay in the response toward a given fluid flow demand.

The development of the accumulator variable with time is further illustrated in table 1.

TABLE 1

| Decision Point | Flow Demand | Accumulator | Decision | Updated Accumulator |
|---|---|---|---|---|
| 1 | 35% | 0% + 35% = 35% | 35% < 100% => vacant cycle | 35% − 0% = 35% |
| 2 | 35% | 35% + 35% = 70% | 70% < 100% => vacant cycle | 70% − 0% = 70% |
| 3 | 35% | 70% + 35% = 105% | 105% ≧ 100% => full cycle | 105% − 100% = 5% |
| 4 | 35% | 5% + 35% = 40% | 40% < 100% => vacant cycle | 40% − 0% = 40% |
| 5 | 35% | 40% + 35% = 75% | 75% < 100% => vacant cycle | 75% − 0% = 75% |
| 6 | 35% | 75% + 35% = 110% | 110% ≧ 100% => full cycle | 110% − 100% = 10% |
| 7 | 35% | 10% + 35% = 45% | 45% < 100% => vacant cycle | 45% − 0% = 45% |
| 8 | 35% | 45% + 35% = 80% | 80% < 100% => vacant cycle | 80% − 0% = 80% |
| 9 | 35% | 80% + 35% = 115% | 115% ≧ 100% => full cycle | 115% − 100% = 15% |
| 10 | 35% | 15% + 35% = 50% | 50% < 100% => vacant cycle | 50% − 0% = 50% |

The mentioned time delay can be addressed by simply changing the threshold value. In the example, shown in FIG. 6, the threshold level is set to 40%. However, different values could be used as well. Furthermore, it is possible, to change the threshold level depending on the demand. The equation for this could be $T=c\cdot 100\%+a$, where T is the modified threshold level, c is a multiplicative constant and a is an additive constant. Hence, the example given with respect to FIG. 6 could be considered as being derived from the given formula with c=0.5 and a=10%.

Of course, setting the threshold level T to a level lower than 100% will cause the accumulator 14 to reach negative values. However, this is not a real problem. The negative value only serves to record excess flow produced during the transient phase of the algorithm.

As can be seen from FIG. 6, the modified threshold level of T=40% will cause the first pumping pulse to be performed 60° earlier in time (one tick represents 60°). Furthermore, the first three-tip spike 16 will occur right in the beginning. Therefore, the time delay in responding to a change in fluid flow demand will decrease.

Additionally, attention is drawn to table 2, where the time development of the accumulator variable is shown in a numerical form.

TABLE 2

| Decision Point | Flow Demand | Accumulator | Decision | Updated Accumulator |
|---|---|---|---|---|
| 1 | 35% | 0% + 35% = 35% | 35% < 40% -> vacant cycle | 35% − 0% = 35% |
| 2 | 35% | 35% + 35% = 70% | 70% ≧ 40% -> full cycle | 70% − 100% = −30% |
| 3 | 35% | −30% + 35% = 5% | 5% < 40% -> vacant cycle | 5% − 0% = 5% |
| 4 | 35% | 5% + 35% = 40% | 40% ≧ 40% -> full cycle | 40% − 100% = −60% |
| 5 | 35% | −60% + 35% = −25% | −25% < 40% -> empty cycle | −25% − 0% = −25% |
| 6 | 35% | −25% + 35% = 10% | 10% < 40% -> vacant cycle | 10% − 0% = 10% |
| 7 | 35% | 10% + 35% = 45% | 45% ≧ 40% -> full cycle | 45% − 100% = −55% |
| 8 | 35% | −55% + 35% = −20% | −20% < 40% -> empty cycle | −20% − 0% = −20% |
| 9 | 35% | −20% + 35% = 15% | 15% < 40% -> vacant cycle | 15% − 0% = 15% |

Another modification is the introduction of a vector instead of a scale for the accumulator.

Figure 8:
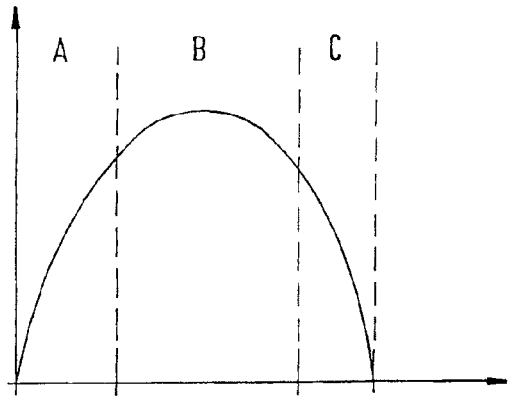
FIG. 8: illustrates the time dependency of the fluid flow output of a full-stroke pumping cycle.

Referring to FIG. 8, the vectorial accumulator can be three-dimensional. The three-dimension represents the sequence of the fluid flow output of the pumping cylinder. In the first third A, 25% of the volume fraction is pumped. In time interval B, 50% of the total volume fraction is pumped, and in time interval C the last 25% of the volume fraction is pumped, although the length of the time intervals A, B, C is the same. This is due to the sinusoidal shape of the movement of piston 6 within cylinder part 5.

Once a pumping cycle is initiated, the vector (−25, −50, −25), representing the time dependant fluid flow output of the respective cylinder will be added to the accumulator vector. The first dimension always represents the actual time interval. Therefore, when modifying the accumulator vector at each decision point, the number within each register will have to be shifted, to represent the advancement in time.

The updating procedure and actuation decisions of the cylinders can be deferred from table 3.

TABLE 3

| Decision Point | Flow Demand | Accumulator 0 | Accumulator 1 | Accumulator 2 | Decision |
|---|---|---|---|---|---|
| 1 | 35% | 35% | 0% | 0% | 35% ≧ 25% -> full stroke |
| 2 | 35% | 10% − 50% + 35% = −5% | 0% − 25% = −25% | 0% | −5% < 25% -> no stroke |
| 3 | 35% | −5% − 25% + 35% = 5% | 0% | 0% | 5% < 25% -> no stroke |
| 4 | 35% | 5% + 35% = 40% | 0% | 0% | 40% ≧ 25% -> full stroke |
| 5 | 35% | 15% − 50% + 35% = 0% | 0% − 25% = −25% | 0% | 0%< 25% -> no stroke |
| 6 | 35% | 0% − 25% + 35% = 10% | 0% | 0% | 10% < 25% -> no stroke |
| 7 | 35% | 10% + 35% = 45% | 0% | 0% | 45% ≧ 25% -> full stroke |
| 8 | 35% | 20% − 50% + 35% = 5% | 0% − 25% = −25% | 0% | 5% < 25% -> no stroke |
| 9 | 35% | 5% + 35% − 25% = 15% | 0% | 0% | 15% < 25% -> no stroke |
| 10 | 35% | 15% + 35% = 50 | 0% | 0% | 50% ≧ 25% -> full stroke |
| 11 | 35% | 25% + 35% − 50% = 10% | 0% − 25% = −25% | 0% | 10% < 25% -> no stroke |
| 12 | 35% | 10% − 25% + 35% = 20% | 0% | 0% | 20% < 25% -> no stroke |
| 13 | 35% | 20% + 35% = 55% | 0% | 0% | 55% ≧ 25% -> full stroke |
| 14 | 35% | 30% + 35% − 50% = 15% | 0% − 25% = −25% | 0% | 15% < 25% -> no stroke |
| 15 | 35% | 15% + 35% − 25% = 25% | 0% | 0% | 25% ≧ 25% -> full stroke |
| 16 | 35% | 0% + 35% − 50% = −15% | 0% − 25% = −25% | 0% | −15% < 25% -> no stroke |
| 17 | 35% | −15% + 35% − 25% = −5% | 0% | 0% | −5% < 25% -> no stroke |
| 18 | 35% | −5% + 35% = 30% | 0% | 0% | 30% ≧ 25% -> full stroke |
| 19 | 35% | 5% + 35% − 50% = −10% | 0% − 25% = −25% | 0% | −10% < 25% -> no stroke |

TABLE 3-continued

| | | | | |
|---|---|---|---|---|
| 20 | 35% | −10% + 35% − 25% = 0% | 0% | 0% 0% < 25% -> no stroke |

| Decision Point | Updated Accumulator 0 | 1 | 2 |
|---|---|---|---|
| 1 | 35% − 25% = 10% | 0% − 50% = −50% | 0% − 25% = −25% |
| 2 | −5% − 0% = −5% | −25% − 0% = −25% | 0% − 0% = 0% |
| 3 | 5% − 0% = 5% | 0% − 0% = 0% | 0% − 0% = 0% |
| 4 | 40% − 25% = 15% | 0% − 50% = −50% | 0% − 25% = −25% |
| 5 | 0% − 0% = 0% | −25% − 0% = −25% | 0% − 0% = 0% |
| 6 | 10% − 0% = 10% | 0% − 0% = 0% | 0% − 0% = 0% |
| 7 | 45% − 25% = 20% | 0% − 50% = −50% | 0% − 25% = −25% |
| 8 | 5% − 0% = 5% | −25% − 0% = −25% | 0% − 0% = 0% |
| 9 | 15% − 0% = 15% | 0% − 0% = 0% | 0% − 0% = 0% |
| 10 | 50% − 25% = 25% | 0% − 50% = −50% | 0% − 25% = −25% |
| 11 | 10% − 0% = 10% | −25% − 0% = −25% | 0% − 0% = 0% |
| 12 | 20% − 0% = 20% | 0% − 0% = 0% | 0% − 0% = 0% |
| 13 | 55% − 25% = 30% | 0% − 50% = −50% | 0% − 25% = −25% |
| 14 | 15% − 0% = 15% | −25% − 0% = −25% | 0% − 0% = 0% |
| 15 | 25% − 25% = 0% | 0% − 50% = −50% | 0% − 25% = −25% |
| 16 | −15% − 0% = −15% | −25% − 0% = −25% | 0% − 0% = 0% |
| 17 | −5% − 0% = −5% | 0% − 0% = 0% | 0% − 0% = 0% |
| 18 | 30% − 25% = 5% | 0% − 50% = −50% | 0% − 25% = −25% |
| 19 | −10% − 0% = −10% | −25% − 0% = −25% | 0% − 0% = 0% |
| 20 | 0% − 0% = 0% | 0% − 0% = 0% | 0% − 0% = 0% |

The fluid flow output is shown in FIG. 7. The accumulator curve 14, shown in FIG. 7, represents the first register of the accumulator vector, i.e. the number representing the actual time interval.

As can be seen from FIG. 7, the time response is faster, as compared to the state of the art, as well: the first pumping stroke is initiated 60° degrees earlier than it is the case in FIG. 5. The three-tip spike 17 occurs earlier as in FIG. 5, as well.

Using the same algorithm with a vectorial accumulator and changing the demand from 0% to 100%, the advantage of the method according to the state of the art is even clearer. According to the state of the art, because of the slow build-up of the accumulator and the delayed initiation of full-stroke pumping cycles, it would take a turning angle of 120° to build up the fluid flow output completely. However, using the vectorial accumulator, the fluid output flow will be at its maximum right from the beginning. The "time" gained is 120° turning angle of rotatable shaft 8. At a revolution speed of 800 rpm (rounds per minute) such an angle is equivalent to a time delay of 25 milliseconds. Such a time delay is already noticeable by the operator.

Another advantage of employing an accumulator vector is, that the time development of a pumping cycle is automatically considered. By the shifting of the vectorial registers, which represent the advancement in time, there is a tendency to smooth the fluid flow output.

Of course, the accumulator vector can have a different dimension as well.

Figure 9:
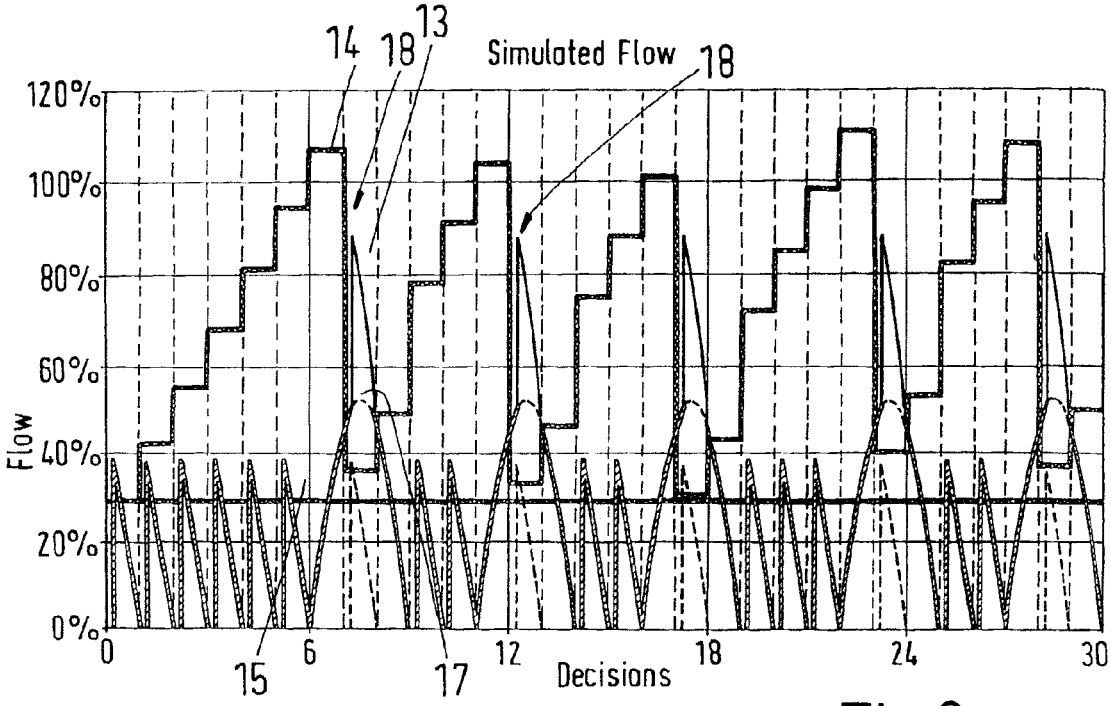
FIG. 9: illustrates the fluid output of a synthetically commutated hydraulic pump, using a standard accumulator, at another fluid flow demand.
Figure 10:
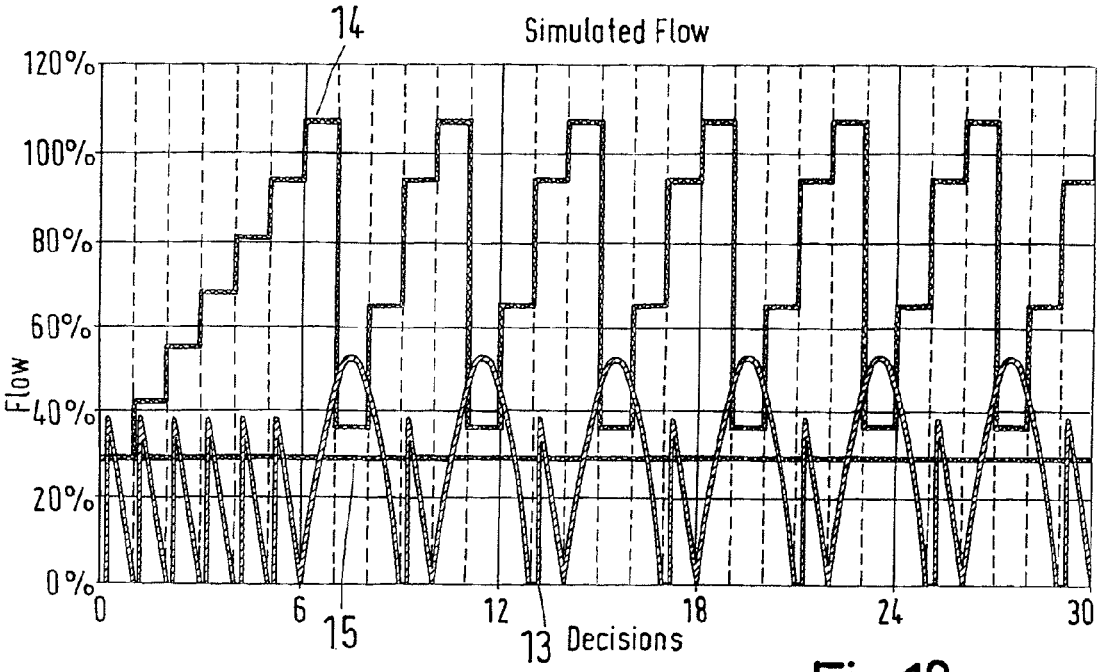
FIG. 10: illustrates the fluid output of a synthetically commutated hydraulic pump, using a spacing function, at a fluid flow demand according to FIG. 9.

By comparing FIGS. 9 and 10, the advantage of a spacing function becomes clear. In both FIGS. 9 and 10, only 16% part-stroke pumping cycles and 100% part-stroke pumping cycles are allowed. The fluid flow demand 15 is set to 29% in both cases.

In FIG. 9, the algorithm according to the state of the art is used. As can be seen from FIG. 9, once the accumulator has overcome the threshold level of 100%, a full-stroke pumping cycle is initiated (the individual fluid output flows of the single cylinders is indicated by a dashed line 17). At the decision point, following immediately after the decision point, where the full-stroke pumping cycle has been initiated, the accumulator 14 will be updated to a value of 45%. Hence, a part-stroke pumping cycle is initiated during the high output flow phase of the full-stroke pumping cycle (compared to FIG. 8, interval B). This results in a very strong peak 18 of the total fluid flow output 13.

Using a spacing function, however, the total fluid flow output 13 looks much better. In the example illustrated in FIG. 10, the spacing function is implemented as a simple condition. If a full-stroke pumping cycle is in its peak fluid output flow phase (see interval B in FIG. 8), no part-stroke pumping cycle will be initiated. This will lead to a much smoother total fluid output flow 13.

The improvement is obvious, when comparing FIGS. 9 and 10.

Additional information can be drawn from the other three applications, filed on the same day by the same applicant under Ref. Nos. DA1708 EP, DA1719 EP and DA1720 EP. The contents of said applications is included into the disclosure of this application by reference.

While the present invention has been illustrated and described with respect to a particular embodiment thereof, it should be appreciated by those of ordinary skill in the art that various modifications to this invention may be made without departing from the spirit and scope of the present invention.

What is claimed is:

1. A method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the pumping and/or motoring strokes of said working chamber are controlled by an appropriate actuation of said electrically actuated valve, wherein the actuation of said electrically actuated valve is modified by a time evolvement function, taking into account the time evolvement of the fluid flow demand on the high-pressure side and/or the time evolvement of said working chamber's pumping/motoring strokes, wherein the time evolvement function comprises a vectorised variable being indicative of the time dependency of the fluid output flow during a pumping stroke.

2. The method according to claim 1, wherein the time evolvement function is able to trigger a pumping/motoring stroke for a plurality of working chambers and/or at a plurality of phases of each working chamber's working cycle.

3. The method according to claim 1, wherein the time evolvement function comprises a spacing function, so that successive pumping/motoring strokes, particularly the peak output phases of successive pumping/motoring strokes, are spaced in time in a way to smooth the fluid output flow to said high-pressure fluid manifold.

4. The method according to claim 1, wherein the time evolvement function comprises a variable being indicative of a fluid flow demand, wherein a threshold level of said variable is chosen in a way that a pumping/motoring stroke is initiated in advance of the actual demand.

5. The method according to claim 1, wherein a plurality of electrically actuated valves are controlled.

6. The method according to claim 1, wherein the pumping/motoring strokes, in particular the initiation of the pumping/motoring strokes of said working chambers are out of phase to each other.

7. A fluid working machine, comprising at least one working chamber of cyclically changing volume, a high-pressure fluid connection, a low-pressure fluid connection, at least one electrically actuated valve connecting said working chamber to said high-pressure fluid connection and/or said low-pressure fluid connection and at least an electronic controller unit, wherein the electronic controller unit comprises a time evolvement consideration means that is designed and arranged in a way, that the electronic controller unit performs a method according to claim 1.

8. A method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the pumping and/or motoring strokes of said working chamber are controlled by an appropriate actuation of said electrically actuated valve, wherein the actuation of said electrically actuated valve is modified by a time evolvement function, taking into account the time evolvement of the fluid flow demand on the high-pressure side and/or the time evolvement of said working chamber's pumping/motoring strokes, wherein the time evolvement function comprises a variable being indicative of a fluid flow demand, wherein a threshold level of said variable is chosen in a way that a pumping/motoring stroke is initiated in advance of the actual demand.

9. The method according to claim 8, wherein the time evolvement function is able to trigger a pumping/motoring stroke for a plurality of working chambers and/or at a plurality of phases of each working chamber's working cycle.

10. The method according to claim 8, wherein the time evolvement function comprises a spacing function, so that successive pumping/motoring strokes, particularly the peak output phases of successive pumping/motoring strokes, are spaced in time in a way to smooth the fluid output flow to said high-pressure fluid manifold.

11. The method according to claim 8, wherein the time evolvement function comprises a vectorised variable being indicative of the time dependency of the fluid output flow during a pumping stroke.

12. The method according to claim 8, wherein a plurality of electrically actuated valves are controlled.

13. The method according to claim 8, wherein the pumping/motoring strokes, in particular the initiation of the pumping/motoring strokes of said working chambers are out of phase to each other.

14. A fluid working machine, comprising at least one working chamber of cyclically changing volume, a high-pressure fluid connection, a low-pressure fluid connection, at least one electrically actuated valve connecting said working chamber to said high-pressure fluid connection and/or said low-pressure fluid connection and at least an electronic controller unit, wherein the electronic controller unit comprises a time evolvement consideration means that is designed and arranged in a way, that the electronic controller unit performs a method according to claim 8.

15. A method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the pumping and/or motoring strokes of said working chamber are controlled by an appropriate actuation of said electrically actuated valve, wherein the actuation of said electrically actuated valve is modified by a time evolvement function, taking into account the time evolvement of the fluid flow demand on the high-pressure side and/or the time evolvement of said working chamber's pumping/motoring strokes, wherein the time evolvement function is able to decide on triggering a pumping/motoring stroke at a plurality of phases of each working chamber's working cycle.

16. The method according to claim 15, wherein the time evolvement function is able to trigger a pumping/motoring stroke for a plurality of working chambers.

17. The method according to claim 16, wherein the time evolvement function is able to trigger essentially simultaneously a plurality of pumping/motoring strokes for a plurality of working chambers.

18. The method according to claim 16, wherein at least two of the plurality of working chambers are in different phases of their respective working cycle.

19. The method according to claim 15, wherein the time evolvement function comprises a spacing function, so that successive pumping/motoring strokes, particularly the peak output phases of successive pumping/motoring strokes, are spaced in time in a way to smooth the fluid output flow to said high-pressure fluid manifold.

20. The method according to claim 15, wherein the time evolvement function comprises a vectorised variable being indicative of the time dependency of the fluid output flow during a pumping stroke.

21. The method according to claim 15, wherein the time evolvement function comprises a variable being indicative of a fluid flow demand, wherein a threshold level of said variable is chosen in a way that a pumping/motoring stroke is initiated in advance of the actual demand.

22. The method according to claim 15, wherein a plurality of electrically actuated valves are controlled.

23. The method according to claim 15, wherein the pumping/motoring strokes, in particular the initiation of the pumping/motoring strokes of said working chambers are out of phase to each other.

24. A fluid working machine, comprising at least one working chamber of cyclically changing volume, a high-pressure fluid connection, a low-pressure fluid connection, at least one electrically actuated valve connecting said working chamber to said high-pressure fluid connection and/or said low-pressure fluid connection and at least an electronic controller unit, wherein the electronic controller unit comprises a time evolvement consideration means that is designed and arranged in a way, that the electronic controller unit performs a method according to claim 15.

25. A method of operating a fluid working machine, comprising at least one working chamber of cyclically changing volume, a high-pressure fluid connection, a low-pressure fluid connection and at least one electrically actuated valve connecting said working chamber to said high-pressure fluid connection and/or said low-pressure fluid connection, wherein the pumping and/or motoring strokes of said working chamber are controlled by an appropriate actuation of said electrically actuated valve, wherein the actuation of said electrically actuated valve is modified by a time evolvement function, taking into account the time evolvement of the fluid flow demand on the high-pressure side and/or the time evolvement of said working chamber's pumping/motoring strokes, wherein the time evolvement function comprises a spacing function, so that successive pumping/motoring strokes are spaced in time in a way to smooth the fluid output flow to said high-pressure fluid manifold.

26. The method according to claim 25, wherein the time evolvement function is able to trigger a pumping/motoring stroke for a plurality of working chambers and/or at a plurality of phases of each working chamber's working cycle.

27. The method according to claim 25, wherein the time evolvement function comprises a spacing function, so that the peak output phases of successive pumping/motoring strokes are spaced in time in a way to smooth the fluid output flow to said high-pressure fluid manifold.

28. The method according to claim 25, wherein the time evolvement function comprises a vectorised variable being indicative of the time dependency of the fluid output flow during a pumping stroke.

29. The method according to claim 25, wherein the time evolvement function comprises a variable being indicative of a fluid flow demand, wherein a threshold level of said variable is chosen in a way that a pumping/motoring stroke is initiated in advance of the actual demand.

30. The method according to claim 25, wherein a plurality of electrically actuated valves are controlled.

31. The method according to claim 25, wherein the pumping/motoring strokes, in particular the initiation of the pumping/motoring strokes of said working chambers are out of phase to each other.

32. A fluid working machine, comprising at least one working chamber of cyclically changing volume, a high-pressure fluid connection, a low-pressure fluid connection, at least one electrically actuated valve connecting said working chamber to said high-pressure fluid connection and/or said low-pressure fluid connection and at least an electronic controller unit, wherein the electronic controller unit comprises a time evolvement consideration means that is designed and arranged in a way, that the electronic controller unit performs a method according to claim 25.

* * * * *